United States Patent [19]

Frank et al.

[11] 4,290,394

[45] Sep. 22, 1981

[54] TWO-CYCLE ENGINE WITH FUEL INJECTION

[75] Inventors: Roy W. Frank; Richard E. Staerzl, both of Fond du Lac, Wis.

[73] Assignee: Brunswick Corporation, Skokie, Ill.

[21] Appl. No.: 128,363

[22] Filed: Mar. 7, 1980

[51] Int. Cl.[3] ..... F02B 33/04; F02M 51/00

[52] U.S. Cl. ..... 123/73 A; 123/73 R; 123/73 B; 123/73 C; 123/59 B; 123/55 VS; 123/472

[58] Field of Search ..... 123/73 A, 73 B, 73 CB, 123/73 C, 73 CC, 73 R, 474, 59 B, 55 VS

[56] References Cited

U.S. PATENT DOCUMENTS

| | | | |
|---|---|---|---|
| 874,822 | 12/1907 | Baird | 123/73 A |
| 1,999,520 | 4/1935 | Stout | 123/73 A |
| 2,397,457 | 3/1946 | Krenzke | 123/73 A |
| 3,280,805 | 10/1966 | Muller | 123/73 R |
| 3,472,211 | 10/1969 | Meininger | 123/73 R |
| 4,204,489 | 5/1980 | Onishi | 123/73 R |

*Primary Examiner*—Wendell E. Burns
*Attorney, Agent, or Firm*—Hopgood, Calimafde, Kalil, Blaustein & Judlowe

[57] ABSTRACT

The invention contemplates electronically controlled fuel-injection for a single or multiple-cylinder two-cycle internal-combustion engine wherein each cylinder has its own independent crankcase region in which to receive and compress inlet air and fuel, prior to delivery of combustible mixture to the head or combustion end of the cylinder. Fuel is injected directly into each crankcase region during only a portion of the stroke involving induced intake of air therein, i.e., during only a portion of the rise of each piston in its approach to top-center position, and while pressure within the crankcase region is relatively uniform. The time-duration of actual injection is relatively short, to enable identical injections in each cylinder, each such injection being identically timed with relation to position and displacement of its associated piston.

11 Claims, 8 Drawing Figures

TWO-CYCLE ENGINE WITH FUEL INJECTION

BACKGROUND OF THE INVENTION

The invention relates to the problem of fuel injection in a single or multiple-cylinder two-cycle engine, and in particular to the economic and reliable electronic control of such injection, particularly for engines having four or more cylinders.

To provide fuel injection in a two-cycle engine of the character indicated, it has been proposed to employ for each cylinder a solenoid-operated injector valve adjacent an injection nozzle, and to make the injection in the intake or plenum passage supplying inlet air and fuel via the check-valve vanes (or reed bank) which retain air and fuel admitted to the crankcase region of the particular cylinder. But this approach imposes severe timing and precision limitations on the injection portion of the cycle; for example, the injection period must be short, to assure that all or substantially all injected fuel can be admitted to the crankcase before the flow rate of induction into the crankcase approaches zero. The penalty for failure to admit all fuel to the crankcase is, in the case of an outboard motor wherein cylinders are in vertically stacked array, to allow unduly enriched fuel-air mixtures in the lower cylinders, meaning inefficiency and failure to achieve design engine output, through an inability to deliver the same fuel-air ratio to all cylinders. Such limitations apply regardless of the sophistication that may be built into individual electronic timing circuits serving the individual fuel injectors.

BRIEF DESCRIPTION OF THE INVENTION

It is an object of the invention to provide an improved fuel-injection two-cycle engine of the character indicated.

Another object is to provide an improved system of fuel-injection in such an engine whereby each of the multiple cylinders receives its aliquot share of the fuel flow, for any given engine-load or speed condition.

A further object is to provide such an engine wherein the time available for fuel injection may be an enlarged fraction of the operating cycle within each cylinder.

It is also an object to provide substantially more simple electronic means for controlling such fuel injection.

A general object is to achieve the above objects with structure of inherent simplicity, low cost, reliability, and flexible adaptation to a wide range of operating conditions.

The foregoing and other objects and features of the invention are realized in single and/or multiple-cylinder two-cycle engines wherein fuel-injection is made directly into the crankcase region of each cylinder and within the time interval of relatively constant pressure which exists prior to the compression phase of the crankcase region. Reliability of operation results from confinement of all fuel-air mixing within individual crankcase regions, there being no possibility of such mixing within the air supply external to any crankcase region; also, the injected fuel for each cylinder is precisely metered and timed so that each cylinder receives its fuel charge in the same relation to the position and displacement of its associated piston.

The invention is illustratively described for the case of a six-cylinder engine.

DETAILED DESCRIPTION

The invention will be described in detail for various embodiments in conjunction with the accompanying drawings, in which.

Figure 2:
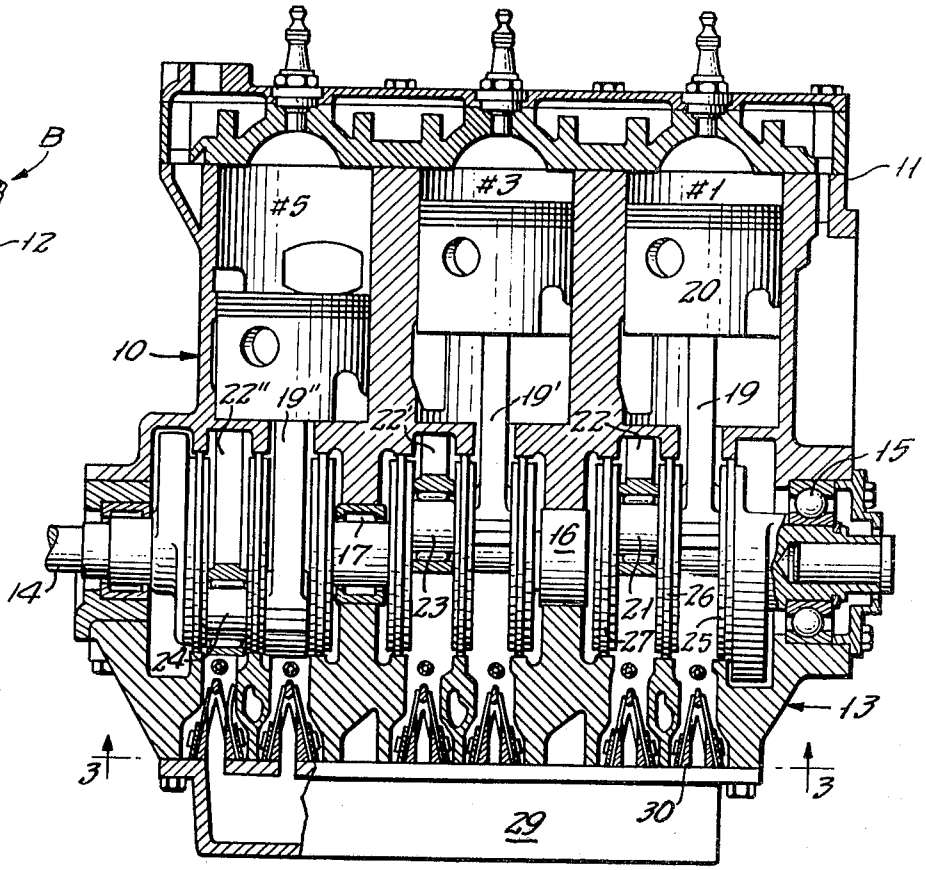
FIG. 2 is a longitudinal sectional view, taken at 2—2, through one of the cylinder banks of the engine of FIG. 1.
Figure 1:
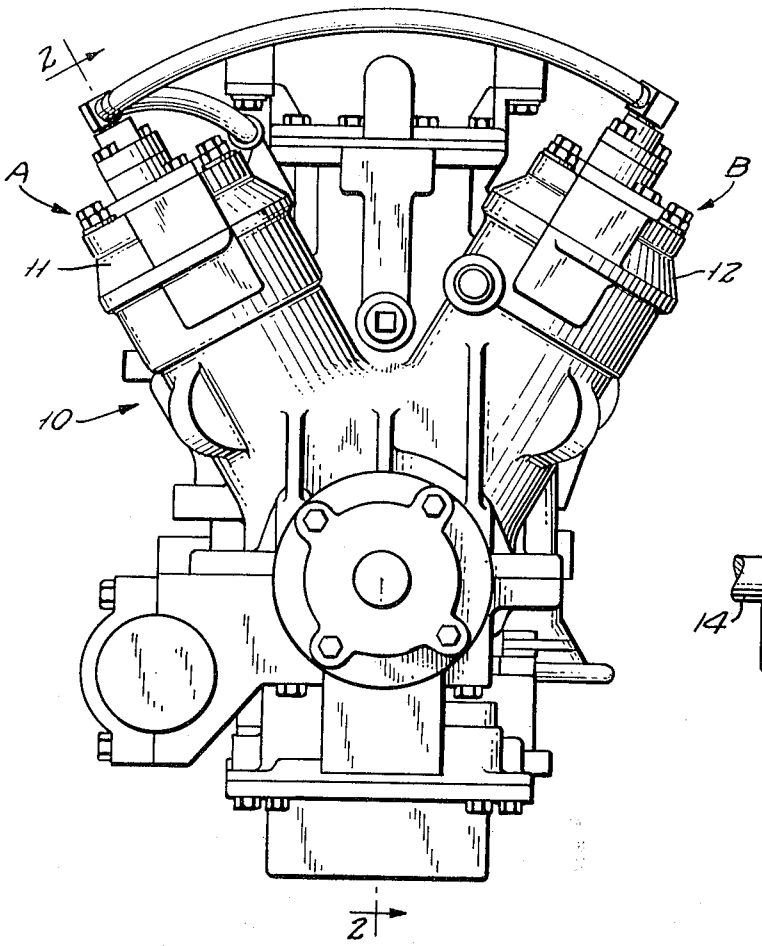
FIG. 1 is an end-elevation view of a V-6 two-cycle outboard engine incorporating the invention.
Figure 3:
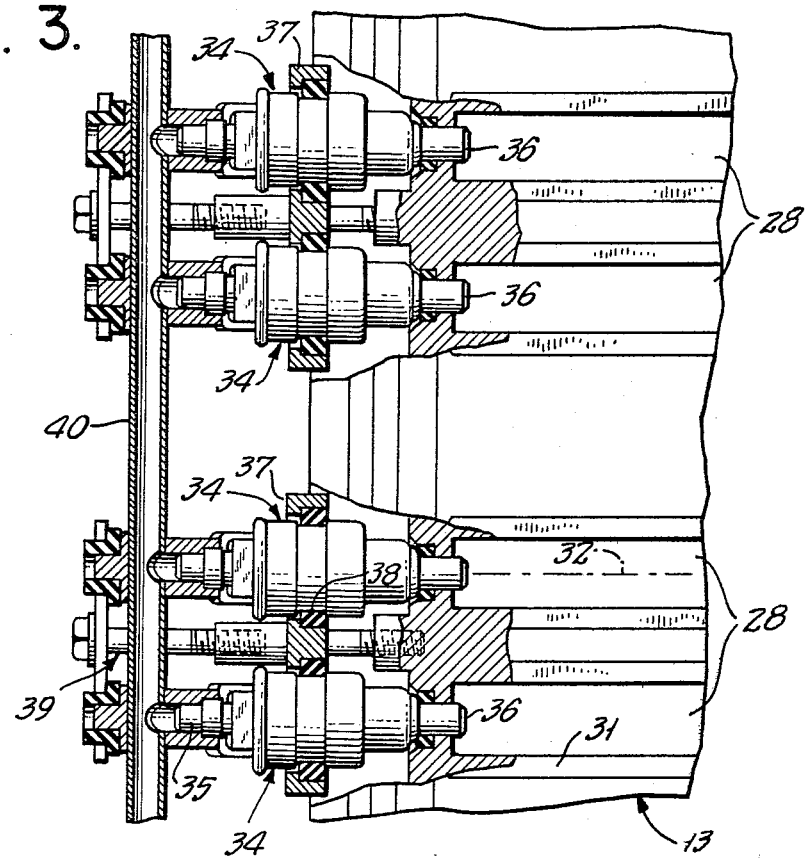
FIG. 3 is a fragmentary view of fuel-injection devices, in partial section, at the plane 3—3 of FIG. 2.

Referring initially to FIGS. 1, 2 and 3, the invention is shown in application to a two-cycle V-6 engine having two banks A-B of three cylinders at 60-degrees angular separation, the sectional view of FIG. 2 being taken through the A bank, comprising cylinders #1, #3 and #5. All cylinders are formed in a single block 10, with cylinder heads 11–12 (and spark plugs) closing cylinders of the respective banks, and with a fuel-air supply block 13 secured to the bottom of the engine block, at the plane of the axis of a crankshaft 14. A ball bearing 15 provides axially located rotary support for one end of crankshaft 14, and additional antifriction support is provided, at two-cylinder intervals, by needle bearings 16-17-18. The cylinders of the respective banks A-B are in spaced radial planes (i.e., staggered interlace) along the crankshaft axis, so that the connecting rod 19 for the piston 20 of cylinder #1 (bank A) may have longitudinally adjacent connection to the same crankshaft throw 21 as does the connecting rod 22 for cylinder #2 (not shown) of bank B, being the next-adjacent cylinder. Succeeding pairs of connecting rods, such as rods 19'–22' for adjacent cylinders #3 and #4, are similarly connected to a second crankshaft throw 23; and rods 19''–22'' for adjacent cylinders #5 and #6 are connected to a third crankshaft throw 24, it being understood that the throws 21-23-24 are at successive 120-degree offsets about the crankshaft axis.

For isolation of a crankshaft region unique to the piston of each cylinder, and to its crankshaft connection, seal discs, such as the discs 25–26 on opposite sides of rod 19 and discs 26–27 on opposite sides of rod 22, are carried for rotation with the crankshaft and have peripheral sealing action with opposed arcuate contours of crankshaft-wall formations in the respective engine blocks 10–13. And separate inlet passages 28 (see FIG. 3) to the respective crankcase regions are served by a single plenum 29, for manifolded supply of inlet air. A system of check valves, in the form of a reed-bank unique to each inlet passage 28, such as the reed-bank 30 at the cylinder #1 location, serves the crankcase region of each cylinder location, thereby assuring automatic closure of each crankcase region when its intake function ends. Such reed-banks are well-understood and therefore require no elaborate description. It suffices to explain that a reed-bank as at 30 comprises an elongate internally open prismatic frame of generally isoceles-triangular section, with base flanges to locate in seating-recess formations 31 (see FIG. 3) adjacent the sidewalls of each passage 28, at the plenum-connection end. The downstream end of each reed-bank 30 is essentially a line extending centrally of the long dimension of the generally rectangular cross-section of each passage 28, such line being suggested by a phantom line 32 for one of the passages 28 in FIG. 3; and check-valve action is via plural stiffly compliant reed members, clamped at one end near the base of the respective sloping sides of the triangular section, with openable coverage of discharge ports near the downstream ends of said sloping sides. The generally triangular section of each reed-bank 30 is displayed in FIG. 2, where a nozzle 36 is identified for fuel-injection into the crankcase of cylinder #3.

In accordance with a feature of the invention, fuel-injection is made unique to each crankcase region and at a location just downstream from the downstream end of each reed-bank 30. For this purpose, a separate solenoid-operated injector assembly 34 is mounted to one side of the intake block, for each crankcase region; such injector assemblies 34 are commercially available and therefore need not be described in detail. It suffices to state that each injector assembly 34 has a fuel-inlet end 35 and an injection nozzle 36 at its opposite end, the discharge axis of nozzle 36 being aligned preferably parallel to and slightly downstream from the downstream-end alignment 32 of the associated reed-bank 30. As seen in FIG. 3, a flanged member 37 is the means of applying clamp pressure via an elastomeric ring 38 for the loading of each injector assembly 34 in sealed seated position for the described direction of injection discharge. The same system of clamp rods 39 which loads member 37 into injector-retaining position also and analogously clamps the fuel-supply header 40 in common to the inlet end 35 of all injector assemblies 34, and it will be understood that fuel-pump means (not shown, but illustratively electric-motor driven) may assure at all times an elevated-pressure condition of fuel at the respective inlets 35; the elevated pressure should be well above any possible crankcase pressure (i.e., well above atmospheric pressure), and may suitably be in the range 30 to 50 psi, the same being regulated in such a manner as to maintain a substantially constant differential pressure across the injectors. Also, the discharge-flow capacity of each injector assembly 34 should be such that even the circumstance of more than one injector 34 simultaneously discharging will not materially reduce the fuel-supply pressure in header 40.

Figure 4:
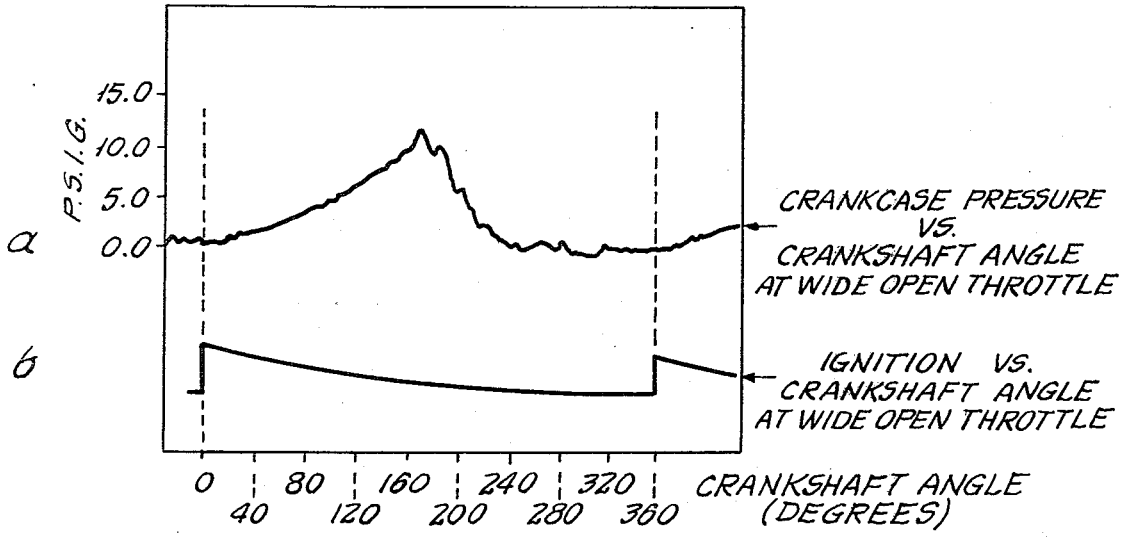
FIG. 4 is a graphical display of crankcase pressure as a function of crank angle for one of the cylinders of the engine of FIGS. 1 and 2.

FIG. 4 is a graphical display to enable an understanding of the ignition function and the crankcase pressure condition, as the same are typically related to crankshaft angle, for the case of any one of the cylinders of the described engine. Such an understanding is needed to appreciate another feature of the invention, having to do with fuel-injection economy and reliability. For consistency in referring all cylinder cyles to the same crankshaft cycle, the pressure and ignition curves of FIG. 4 will be stated to apply for cylinder #1.

For convenience in FIG. 4, ignition time for the displayed cylinder is taken as the origin for the 360-degree cycle of bottom-cylinder (i.e., a crankcase, curve a) and top cylinder (curve b) conditions, it being clear from the curve of crankcase pressure that pressure conditions are at their lowest, i.e., near atmospheric pressure (0 psig) over a substantial angular spread, from about the 200-degree crankshaft position (for the particular cylinder's piston), past the ignition position, and until about 60 degrees into the ensuing cycle. This represents a relatively generous fraction (namely, 220 degrees) of the total cycle, within which fraction crankcase pressure is close to atmospheric pressure and very definitely less than a 5 psi pressure differential. Thus, over this 220-degree fraction of crankshaft rotation, the pressure-differential which determines quantity of injected-fuel for a given injector-discharge interval will be fairly constant, the percent variation from constant being smaller the greater the fuel-supply pressure in line 40; e.g., for 50 psig supply pressure, the variation of this pressure difference is less than 10 percent. The crankcase pressure and the plenum pressure are substantially the same when the reeds are open.

Figure 5:
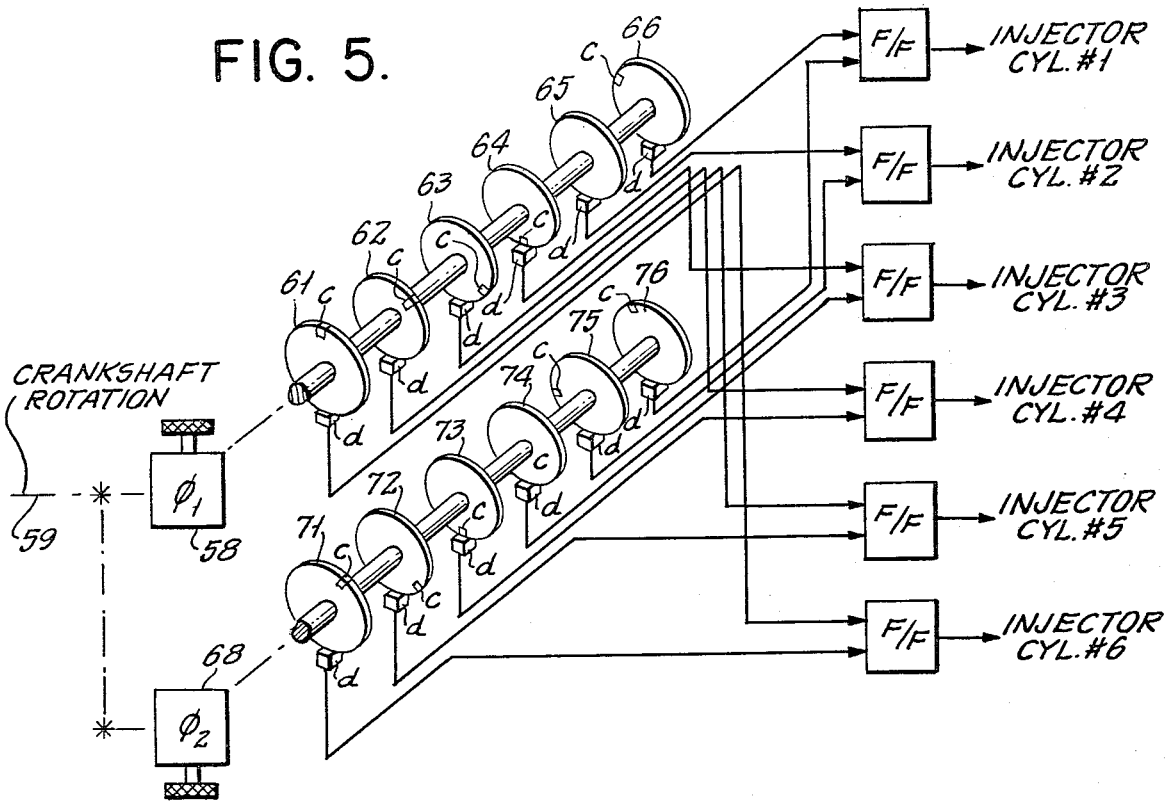
FIG. 5 is a simplified diagram, partly isometric, schematically indicating control means for fuel-injection devices of the engine.

FIG. 5 provides schematic illustration of means whereby the solenoid associated with each injector assembly 34 is given the correct-length and correctly timed excitation pulse, appropriate to the individual operational phase of the associated piston in its cylinder. For generating a separate such pulse for each injector solenoid, a bi-stable flip-flop pulse generator 51 (52-53 . . . 56) has an a input to receive a starting-control pulse and a b input to receive a termination-control pulse. Each starting-control pulse is initiated by electromagnetic induction, marking a particular angle of crankshaft rotation, and involving a particular one of a plurality of discs 61 (62-63 . . . 66) fixed to a first shaft 57 directly coupled one-to-one, via phase-adjustment means 58 to the crankshaft (suggested at 59). Such induction involves a permanent-magnet insert c in each disc, to mark 60-degree increments from one to the next of the discs 61 . . . 66; and aligned fixed induction coils d associated with each of the respective discs generate a-input pulses to the flip-flops in 60-degree timed succession. In similar fashion, a second set of timing discs 71 . . . 76 on a second shaft 67 is also connected by phase-adjustment means 68 for one-to-one drive from the crankshaft connection 59, and the respective magnetic inserts c of discs 71 . . . 76 are so phased with respect to the inserts c of corresponding discs 61 . . . 66 that desired pulse intervals (in terms of crankshaft rotation) are defined; induction coils d associated with discs 71 . . . 76 are connected to the b inputs of the corresponding flip-flops 51 . . . 56. It is seen that a first phase adjustment $\phi_1$ at 58 determines for each cylinder identically the same solenoid-actuation time, in terms of the instantaneous piston phase in the associated cylinder, and that a second phase adjustment $\phi_2$ at 68 similarly determines for each cylinder identically the same solenoid-deactivation time, thus assuring equal and consistently phased fuel-injection "shots" in the crankcases of all cylinders. The schematic showing in FIG. 5 provides a knob for each of the "starting" and "termination" phase adjustments ($\phi_1$, $\phi_2$), but this schematic showing will be understood to contemplate computer-developed adjustments of $\phi_1$ and/or $\phi_2$, automatically responsive say to such factors as instantaneous air-mass flow, engine speed, engine-throttle setting and the like, as discussed in greater detail in copending Richard Elmar Staerzl application, Ser. No. 120,467, filed Feb. 11, 1980.

Figure 6:
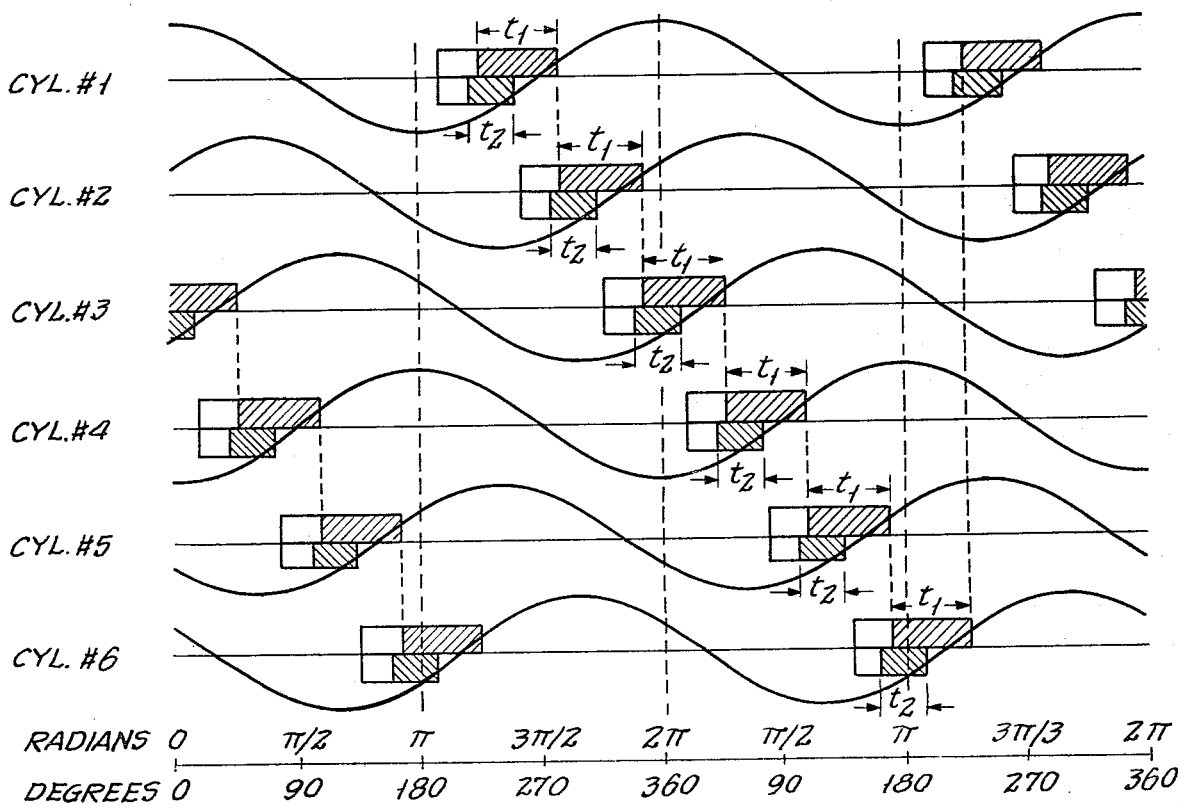
FIG. 6 is a graphical display of piston position as a function of crank angle, covering two full cycles of operation, for each of the six cylinders of the engine of FIGS. 1 and 2, with additional plots of fuel-injection timing, as applicable to the respective cylinders.

The invention utilizes the above observation as to substantially uniform injection-pressure differential in each of several alternative configurations, a first of which is illustrated in FIG. 6.

FIG. 6 depicts the six-cylinder situation wherein all injector assembles 34 are served by the same header 40 and are of such capacity as to enable full-throttle use at full speed, in the circumstance of no overlap of any one cylinder-injection time with that of any other cylinder. This necessarily means that the injector assemblies 34 are, for the particular engine size, able to discharge the maximum volume of injected fuel within approximately 60 degrees of crankshaft rotation, at full-throttle, in approach to full speed. For the case of an engine with a top speed of 5500 rpm, 60 degrees of crankshaft rotation occurs in 3.0 milliseconds (MS); therefore, assuming that approximately one mill second is required in which the injector solenoid overcomes armature and valve-member inertia, and in which fuel-discharge flow can build from zero of maximum, the maximum length of solenoid-energizing pulse needed by the engine at full speed will be 4.0 MS.

Referring more particularly to FIG. 6, the individual cycles of all six cylinders are related to the same two full revolutions of the crankshaft, commencing with the firing (or top-cylinder) instant in the cycle of cylinder #1. The setting of phase adjustment $\phi_1$ (at 58) is such that all injector assemblies 34 are excited by development of a-input pulses at about the 210-degree point in the cycle of each cylinder. For an engine at high speed, such as 5500 rpm, and assuming a 1-MS inertia lag, the crankshaft rotates approximately 20 degrees (to about the 230-degree point) before onset of injection-fuel delivery to the particular crankcase. The injection continues for the period determined by the next b-input pulse to the particular flip-flop 51 . . . 56, for a fully metered injection of fuel in the 60 degree period ending at approximately the 290-degree point in the cycle of each cylinder.

The described full-throttle situation is depicted in FIG. 6 by the upper-bar pattern shown for each cycle of each cylinder, there being an unshaded region of the bar attributable to the indicated inertia-lag effect, and there being a shaded region of the bar, of duration $t_1$, during which fuel-injection occurs. Also depicted for each cycle of each cylinder is a lower-bar pattern of unshaded vs. shaded regions of a shorter bar, starting at the same instant as the upper bar, but reflecting the lesser degrees of crankshaft rotation during the 1-MS inertia lag and during the lesser-throttle situation which applies for, say, a cruising-speed operation of the engine. As shown, "cruising" fuel-injection is for approximately 30 degrees of crankshaft rotation, indicated as the duration $t_2$. It will be understood that $\phi_1$ adjustment will shift the initiation point for all a-input signals, without causing any of the full-throttle injection periods $t_1$ to overlap. This adjustment may be made to any point within the range 210 degrees to 40 degrees (i.e., 360°+40°) as long as $t_1$ falls within such range. Throttle control is obtained by holding $\phi_2$ fixed while varying $\phi_1$, or by holding $\phi_1$ fixed while varying $\phi_2$, or by a combination of the two variations.

Figure 7:
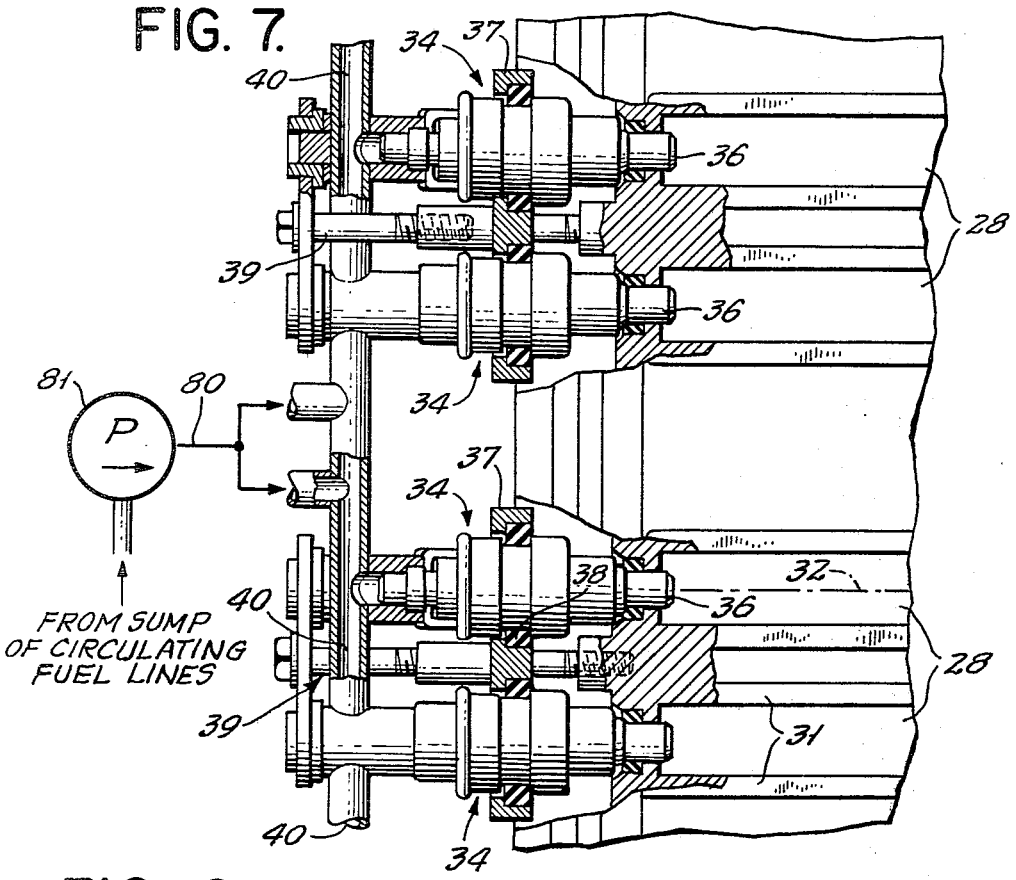
FIG. 7 is a view similar to FIG. 3 to show an alternative fuel-injector arrangement.

The arrangement of FIG. 7 illustrates that a greater range of throttle control may be available, effectively without deleterious overlap of fuel-injection at two cylinders, by using separate fuel-supply headers 40–40′ which run spaced parallel courses, the header 40 serving, say, injector assemblies 34 for the three odd-numbered cylinders, and the header 40′ serving injector assemblies 34 for the three even-numbered cylinders. Both headers 40–40′ are shown served by common connection 80 to a fuel pump 81 of adequate capacity, preferably continuously circulating fuel via both headers to sump, as suggested by legend in the drawing. The header 40 is shown in section, and fragmentary, in a plane above the plane of the header 40′, and the clamp rods 39 are between these planes.

Figure 8:
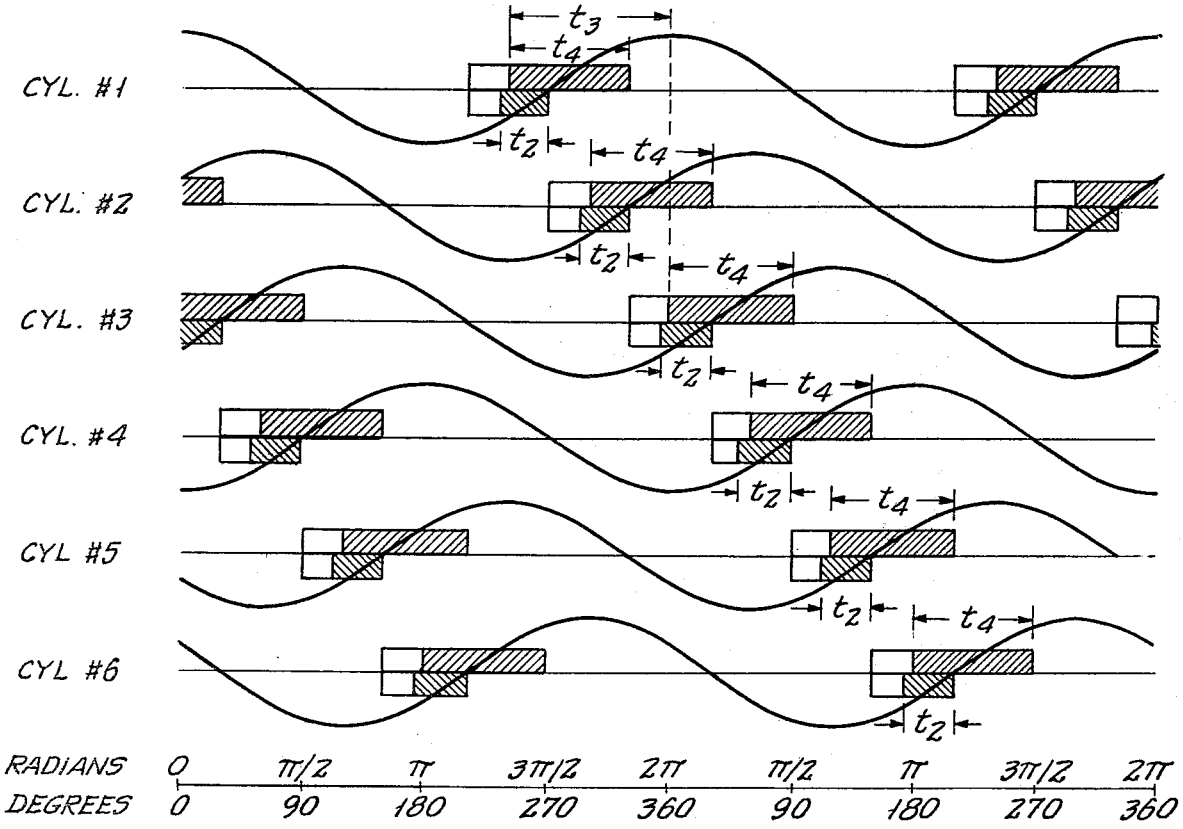
FIG. 8 is a graphical display similar to FIG. 6, but applicable to the fuel-injector arrangement of FIG. 7.

FIG. 8 depicts operation as described for FIG. 6, except that the maximum crankshaft angle $t_3$ available for fuel injection is 120 degrees, without encountering the circumstance of overlapping injection time as between any two cylinders served by a single header. With such greater available time, the injector assemblies 34 to serve in FiG. 7 may be of lesser flow-delivery capacity than those serving the FIG. 3 arrangement. The unshaded vs. shaded upper-bar symbolism for each cylinder reflects a substantially full throttle condition of duration $t_4$, well within the limit $t_3$ and yet representing utilization of substantially three times the $t_2$degrees of crankshaft displacement involved in the cruising-speed situation, depicted in the lowerbar symbolism and already described in connection with FIG. 6.

The described embodiments of the invention will be seen to have achieved all stated objects. In particular, fast response to throttle position (one or the other, or both, of adjustment $\phi_1$ , $\phi_2$) is realized by injection directly into individual crankcase regions of the respective cylinders. By making such injection on the downstream side of the intake check-valve or reed-bank locations, there is assurance against the backfiring, coughing and sputtering often associated with carburetor systems. The timing of fuel injection, and the pressure at which fuel is injected, are such that crankcase pressure has very little effect on fuel-injection metering. And better fuel distribution is achieved by injecting transverse to the intake flow and so as to involve the flow contribution of every reed, thus enabling the engine to run leaner (with improved economy) and enabling production of greater power and performance efficiency.

While the invention has been described in detail for the preferred embodiments shown, it will be understood that modifications may be made without departure from the claimed invention. Thus, overlapping injection periods at successive cylinders may be tolerated in the single-header (40) situation of FIG. 3, provided that the single header and fuel flow circulating therein are sufficiently large to assure against a deleterious change in the pressure difference across the injector assemblies 34 involved at any single time.

What is claimed is:

1. In a two-cycle internal-combustion engine comprising at least one cylinder having an associated crankcase with a gas-flow inlet including a check valve, said cylinder having an exhaust outlet independent of the associated crankcase region, means operating in timed relation with a piston in said cylinder for admitting to the associated combustion region gas compressed in the crankcase region, a crankshaft connected to the piston, an electrically operable fuel-injection device associated with said cylinder for injecting fuel into the crankcase region of the cylinder, and control-signal generator means having a synchronizing connection to the crankshaft and having an operating output connection to said fuel-injection device, said control-signal generator means being operative to cause fuel-injection by said device during the period of piston rise to top-cylinder position, and means for selectively varying the interval of crankshaft rotation during which said output connection is operative to cause such fuel-injection.

2. The engine of claim 1, in which the location of fuel injection is near said check valve.

3. The engine of claim 1, in which said check valve has a general region of downstream discharge into the crankcase region, the location of fuel injection being substantially in said general region of downstream discharge.

4. The engine of claim 1, in which said check valve comprises an elongate bank of reed elements arrayed transverse to the path of inlet-air flow into the crankcase region, said fuel-injection device comprising a nozzle oriented to discharge along an axis that is (a) transverse to said path and (b) parallel to the array orientation of said reed-bank and (c) near the location of reed-bank discharge into the crankcase region.

5. The two-cycle engine of claim 4, in which the reed elements of said bank are in paired and opposed adjacency.

6. In a two-cycle internal combustion engine having n cylinders, each cylinder having an associated crankcase with a gas-flow inlet including a check valve, and each cylinder having an exhaust outlet exclusive of the associated crankcase region, means operating in timed relation with a piston in each cylinder for admitting to the associated combustion region gas compressed in the associated crankcase region, a crankshaft connected to the pistons of said cylinders, an electrically operable fuel-injection device associated with each cylinder for injecting fuel into the crankcase region of that cylinder, and control-signal generator means having a synchronizing connection to the crankshaft and producing a square-wave output-pulse signal in each of n independent operating output connections to said fuel-injection devices, the timing of the respective output signals to successive cylinders being phase-offset to the extent of $(2\pi)/n$ radians, said generator means being operative for each cylinder to cause fuel-injection by the associated said device during the period of piston rise to top-cylinder position, and means for selectively varying the interval of crankshaft rotation during which said output connection is operative to cause such fuel-injection.

7. The engine of claim 6, in which each check valve comprises an elongate bank of reed elements arrayed transverse to the path of inlet-air flow into the crankcase region of the associated cylinder, the associated fuel-injection device comprising a nozzle oriented to discharge along an axis that is (a) transverse to said path and (b) parallel to the array orientation of said reed-bank and (c) near the location of reed-bank discharge into the associated crankcase region.

8. The two-cycle engine of claim 7, in which the reed elements of said bank are in paired and opposed adjacency.

9. The engine of claim 6, in which the maximum interval of crankshaft rotation per fuel-injection discharge is substantially $(2\pi)/n$ radians.

10. The engine of claim 6, where n is even and at least 4, and wherein fuel supply to said injection devices is via a first header serving injection devices of odd-numbered cylinders and is via a second header serving injection devices of even-numbered cylinders.

11. The engine of claim 10, in which the maximum interval of crankshaft rotation per fuel-injection discharge is substantially $\pi/n$ radians.

* * * * *